United States Patent [19]

Ito et al.

[11] Patent Number: 4,701,729

[45] Date of Patent: Oct. 20, 1987

[54] MAGNETIC APPARATUS INCLUDING THIN FILM YIG RESONATOR

[75] Inventors: Seigo Ito, Tokyo; Yoshikazu Murakami, Kanagawa, both of Japan

[73] Assignee: Sony Corporation, Tokyo, Japan

[21] Appl. No.: 708,851

[22] Filed: Mar. 6, 1985

[30] Foreign Application Priority Data

Mar. 8, 1984 [JP] Japan ..... 59-44244

[51] Int. Cl.[4] ..... H01P 7/00

[52] U.S. Cl. ..... 333/219; 333/234

[58] Field of Search ..... 333/202, 219, 234, 235, 333/204

[56] References Cited

U.S. PATENT DOCUMENTS

| | | | |
|---|---|---|---|
| 3,016,497 | 1/1962 | Kostelnick | 333/204 X |
| 3,740,675 | 6/1973 | Moore et al. | 333/202 X |
| 4,096,461 | 6/1978 | Roschmann | 333/219 X |
| 4,152,676 | 5/1979 | Morgenthaler et al. | 333/202 X |
| 4,169,253 | 9/1979 | Cohen | 333/235 X |
| 4,197,517 | 4/1980 | Vittoria | 333/235 X |
| 4,547,754 | 10/1985 | Murakami et al. | 333/219 |

FOREIGN PATENT DOCUMENTS

| | | | |
|---|---|---|---|
| 0939191 | 9/1982 | U.S.S.R. | 333/202 |

*Primary Examiner*—Eugene R. LaRoche
*Assistant Examiner*—B. Lee
*Attorney, Agent, or Firm*—Hill, Van Santen, Steadman & Simpson

[57] ABSTRACT

Disclosed herein is a magnetic apparatus comprising: a magnetic circuit including magnetic yoke and a magnet, with a magnetic gap formed in the circuit for forming a uniform d.c. bias magnetic field in the magnetic gap; a magnetic device made of magnetic material of certain composition and placed in the magnetic gap so that the device operates in the d.c. bias magnetic field; and a soft magnetic plate provided in the magnetic gas, the soft magnetic plate being made of magnetic material having composition substantially identical to the composition of the magnetic device.

6 Claims, 8 Drawing Figures

MAGNETIC APPARATUS INCLUDING THIN FILM YIG RESONATOR

BACKGROUND OF THE INVENTION

1. Field of the Invention

The present invention relates to a magnetic apparatus such as, for example, a microwave filter, including a magnetic device, e.g., a ferromagnetic resonator, which is formed of yttrium iron garnet (YIG) and which is operated in a d.c. bias magnetic field.

2. Prior Art

A ferromagnetic resonator, e.g., a device using ferrimagnetic resonance of an YIG thin film device, has a resonant frequency which is dependent on the saturation magnetization of the device, and therefore the resonant frequency is directly affected by the temperature characteristics of the saturation magnetization. In order for the YIG thin film device to have a constant resonant frequency (fo) independently of the temperature (T), the device needs to be placed in a thermostatic chamber so that the device is kept at a constant temperature, or biased by an offset magnetic field which is proportional to the temperature dependent variation of the YIG saturation magnetization $4\pi M_s$ (Gauss), in addition to the application of a constant d.c. magnetic field which determines the resonant frequency, fo.

Assume in a magnetic circuit, the magnetic field strength Hg in a magnetic gap where a YIG device is placed is given as follows.

$$H_g(T)=(fo/\gamma)+N_{zy}\cdot 4\pi M_{sy}(T) \tag{1}$$

where Nzy is the demagnetization factor of YIG, and $\gamma$ is the gyromagnetic ratio. Accordingly, by varying Hg(T) in proportion to the YIG saturation magnetization $4\pi M_{sy}(T)$ which varies with the temperature T, the resonant frequency, fo, can be maintained constant. Two conceivable methods for varying the magnetic field which are applied to the YIG device in response to the change in the temperature of the device are the use of an electromagnet, and the use of a combination of a permanent magnet and a soft magnetic plate.

However, either the case of using an electromagnet and the case of using a thermostatic chamber requires a supply of energy such as a controlled current from the outside, which results in a complex structure. According to one method of controlling the temperature characteristics of the gap magnetic field $H_g$ with a soft magnetic plate, the gap magnetic field $H_g$ is designed to have the temperature characteristic which is proportional to the temperature characteristic of a ferromagnetic resonator device, e.g., an YIG device, by superimposition of the temperature characteristic of the permanent magnet and the temperature characteristic of the soft magnetic plate so as to compensate for the temperature dependency of the resonant frequency, fo, of the device, whereby fo can be made constant over a wide temperature range.

Illustrated in FIG. 1 is a magnetic circuit consisting of a "C"-shaped yoke 1, which is provided at its confronting end sections with pairs of permanent magnets 2 and soft magnetic plates 3 made of, for example, a ferrite or an alloy of iron, and a magnetic gap 4 with a spacing of $l_g$ which is formed between the soft magnetic plates 3. In the figure, $l_m$ represents the total thickness of the magnet 2, $l_x$ is the total thickness of the soft magnetic plates 3, $B_m$ and $H_m$ are the magnetic flux density and magnetic field strength in each magnet 2, $B_x$ and $H_x$ are the magnetic flux density and magnetic field strength in each soft magnetic plates 3, and $B_g$ and $H_g$ are the magnetic flux density and magnetic field strength in the magnetic gap 4. The permanent magnets 2 are situated in a demagnetizing field, and thus the magnetic field strength $H_m$ is opposite to the magnetic flux density $B_m$. The CGS unit system is used throughout the following discussion.

The Maxwell's equations for the above-mentioned magnetic circuit are expressed in terms of the magnetic flux density and the magnetic field as follows.

$$\int_v divB \cdot dv = \int_s B \cdot ds = 0 \tag{2}$$

$$\int_s rotH \cdot ds = \oint_c H \cdot dl = 0 \tag{3}$$

On the assumption that the magnetic field and magnetic flux density are uniform in the magnet and soft magnetic plates and that there is no magnetic flux leakage outside the circuit, Equations (2) and (3) are reduced as follows to:

$$B_m=B_x=B_g \tag{4}$$

$$l_m\cdot H_m=l_g\cdot H_g+l_x\cdot H_x \tag{5}$$

Provided the magnetization of the soft magnetic plate is $4\pi M_x$, the internal magnetic field $H_x$ of the soft magnetic plate is given as follows.

$$H_x=H_g-N_{zx}\cdot 4\pi M_x \tag{6}$$

where $N_{zx}$ represents the demagnetization factor for the soft magnetic plate, and it is approximated by the following equation when the soft magnetic plate is a thin disk with a diameter of D and a thickness of $S(S=\frac{1}{2}l_x)$.

$$N_{zx} = 1 - \frac{S/D}{\{1-(S/D)^2\}^{\frac{1}{2}}} \tag{7}$$

In case the internal magnetic field of the soft magnetic plate is sufficiently strong, the term $4\pi M_x$ in Equation (6) is replaced with the saturation magnetization $4\pi M_{sx}$.

Substituting Equation (6) into (5), the gap magnetic field Hg is expressed as follows.

$$H_g = \frac{l_m \cdot H_m + l_x \cdot N_{zx} \cdot 4\pi M_{sx}}{l_g + l_x} \tag{8}$$

Accordingly, the gap magnetic field Hg is expressed as a function of the temperature T in terms of the internal magnetic field strength $H_m(T)$ and the magnetization strength $4\pi M_{sx}(T)$ of the soft magnetic plate both at a temperature of T, as follows.

$$H_g(T) = \frac{l_m \cdot H_m(T) + l_x \cdot N_{zx} \cdot 4\pi M_{sx}(T)}{l_g + l_x} \tag{9}$$

Accordingly, by choosing the characteristics and dimensions of the magnets 2 and the soft magnetic plates 3 and the length of the gap, i.e., $H_m$, $4\pi M_{sx}$, $N_{zx}$, $l_m$, $l_x$, and $l_g$, an optimum $H_g$ can be obtained from Equation (9).

In practice, the characteristics of the soft magnetic plate are adjusted so that, for example, by choosing the composition and sintering condition of ferrite, by choosing the composition of the alloy, or by using several kinds of soft magnetic plates in combination. However, even for the selection of the composition and processing conditions of the soft magnetic plate, it is extremely difficult to model the $H_g$ to the desired temperature characteristics of the ferromagnetic resonator device so as to obtain the proper slope and curvature. For this reason, it has not been feasible to maintain constant the resonant frequency, fo, of a ferrimagnetic resonator device, e.g., YIG device, over a wide temperature range.

SUMMARY OF THE INVENTION

An object of the present invention is to provide a magnetic apparatus having improved temperature characteristics.

Another object of the invention is to provide a magnetic apparatus having stable operational characteristics over a wide temperature range.

A further object of the invention is to provide a ferromagnetic resonator having a resonant frequency which is stabilized over a wide temperature range.

Still another object of the invention is to provide a ferromagnetic resonator which has an improved temperature characteristics.

According to one aspect of the present invention, there is provided a magnetic apparatus which comprises a magnetic circuit including a magnetic yoke and a magnet with a magnetic gap formed in the circuit for forming a uniform d.c. biasing magnetic field in the magnetic gap, a magnetic device made of magnetic material of selected composition which is placed in the magnetic gap so that the device operates in the d.c. biasing magnetic field, and a soft magnetic plate is provided in the magnetic gap. The soft magnetic plate is made of a magnetic material having a composition which is substantially identical to the composition of the magnetic device.

According to another aspect of the present invention, there is provided a ferromagnetic resonator which comprises a magnetic circuit including a magnetic yoke and a magnet with a magnetic gap formed in the circuit for forming a uniform d.c. biasing magnetic field in the magnetic gap, a ferromagnetic resonator device formed of a thin film of ferrimagnetic yttrium iron garnet having a selected composition and which is placed in the magnetic gap so that the device operates in the d.c. magnetic field, and a soft magnetic plate provided in the magnetic gap. The soft magnetic plate is made of ferrimagnetic yttrium iron garnet having a composition which is substantially identical to the composition of the resonator device.

DESCRIPTION OF THE PREFERRED EMBODIMENT

The present invention comprises a magnetic apparatus including a magnetic device which operates in a d.c. biasing magnetic field, wherein a magnetic circuit for producing the d.c. biasing magnetic field is constructed by incorporating a soft magnetic plate formed of a material of substantially the same composition, or preferably, exactly the same composition as the magnetic device so that the magnetic circuit has a similar or exactly equal temperature characteristic as the magnetic device.

Figure 2:
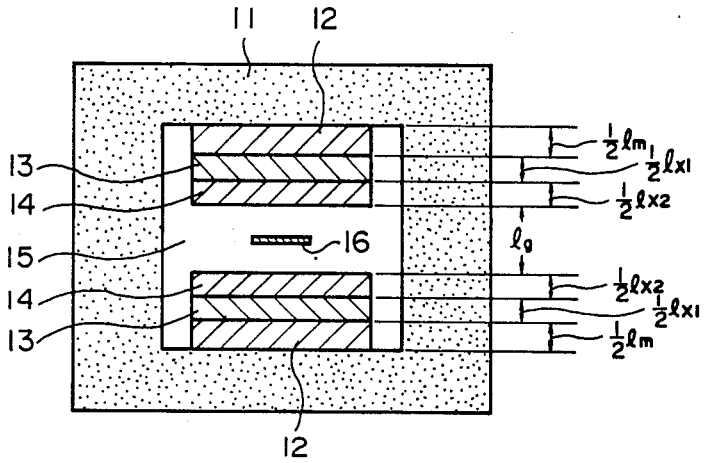
FIGS. 2, 3 and 6 are schematic illustrations showing structures of the magnetic apparatus according to the present invention.
Figure 3:
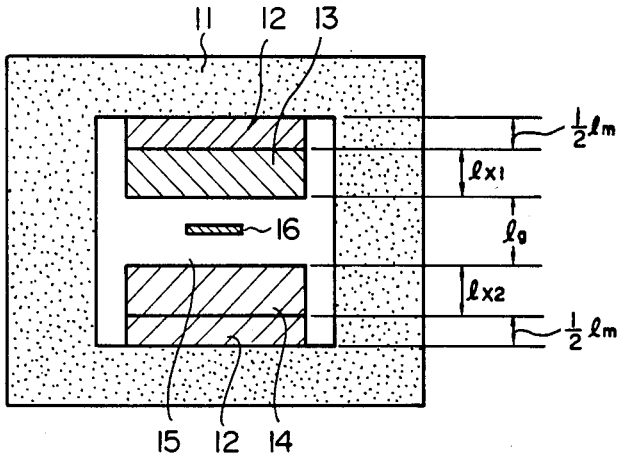

FIGS. 2 and 3 show embodiments of this invention and, the arrangement includes a yoke 11 having four sides, with two confronting sides provided with magnets 12. First and/or second soft magnetic plates 13 and 14 having different compositions are respectively mounted on the magnets 12, as shown. The arrangement of FIG. 2 includes a pair of first and second soft magnetic plates 13 and 14 affixed to each of the magnets 12 and a magnetic gap 15 is formed between the plates 13 and 14. The arrangement of FIG. 3 includes a first soft magnetic plate 13 affixed to the magnet 12 on one side and a second plate 14 on the other side, with a magnetic gap 15 formed between the soft magnetic plates 13 and 14. Placed in the magnetic gap 15 is a magnetic device 16, which is, a YIG ferrimagnetic resonator device. At least one of the soft magnetic plates, such as, the first plate 13, is formed of a material with substantially the same composition as of the magnetic device 16, and it is a YIG plate the same composition, and the other soft magnetic plate 14, is formed of another magnetic material, such as ferrite.

EMBODIMENT 1

In accordance with the basic structure shown in FIG. 3, the first soft magnetic plate 13 is formed of YIG and the second soft magnetic plate 14 is formed of a Mg-Mn-Al ferrite. A permanent magnet made of $SmCo_5$ having a 30 mm diameter (with residual magnetic flux density Br=8134G, coersive force Hc=7876 Oe, temperature coefficient $\alpha=-0.0005$, and with exponential temperature characteristics) is used for the magnet 12. A YIG disk with a 2 mm diameter and a 20 $\mu$m thickness is used for the magnetic device 16, and it is placed in the magnetic gap 15 with a gap length $l_g=2$ mm. Device 16 may be made of a thin film of yttrium iron garnet formed on a non-magnetic garnet material with a process of liquid phase epitaxial growth. The thickness $l_m$ of the magnet 12 is chosen so that the device 16 resonates at a resonant frequency fo=3 GHz.

Figure 1:
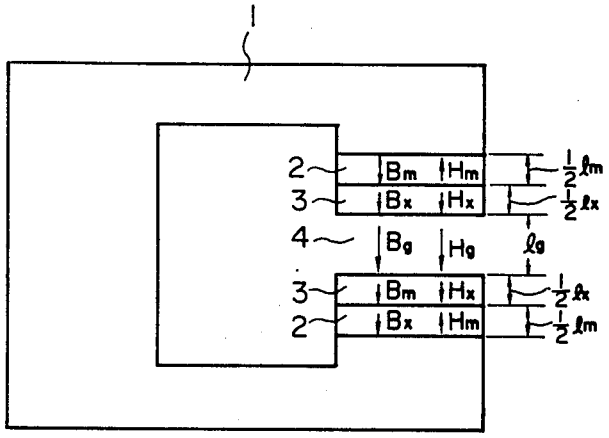
FIG. 1 is an illustration showing schematically the structure of the conventional magnetic apparatus.
Figure 4:
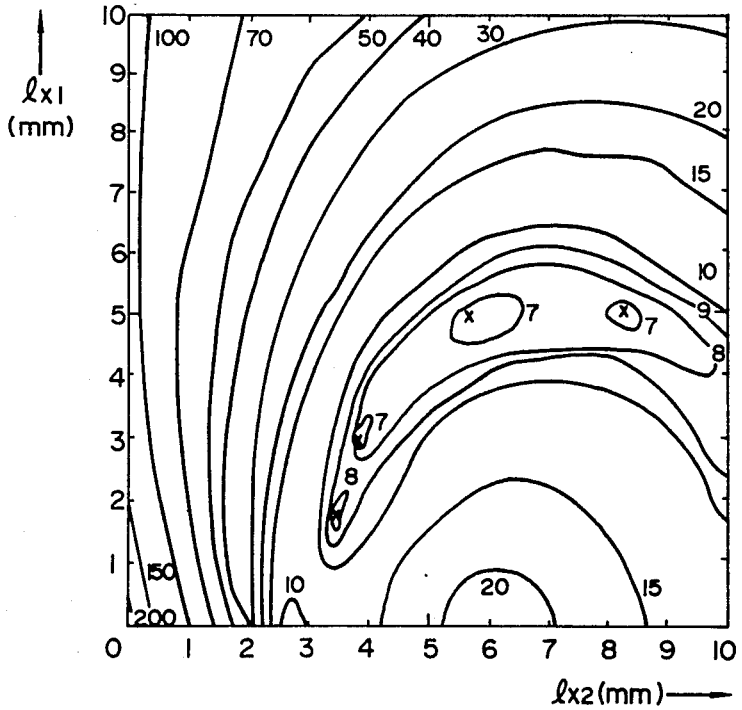
FIGS. 4 and 5 are graphical representations each showing the relationship between the dimensions of the soft magnetic plate and the variation in the resonant frequency as a function of the temperature.

FIG. 4 shows the frequency variation $\Delta f$ ($\pm$MHz) from fo plotted on a plane of the thickness $l_{x1}$ (vertical axis) and $l_{x2}$ (horizontal axis) of the first and second soft magnetic planes 13 and 14 link to form contour lines, with the ambient temperature varied in the range from $-20°$ C. to $+60°$ C. Numerals indicating each contour line in the figure represent the absolute values of the frequency variation in MHz. As indicated by the graph, the arrangement which uses two kinds of soft magnetic plates is capable of greatly removing the temperature dependency of the resonant frequency as compared with the structures using soft magnetic plates made solely of ferrite as shown in FIG. 1. The following Table 1 lists the thicknesses of $l_m$ of the magnet, thicknesses $l_{x1}$ of YIG plate, thicknesses $l_{x2}$ of the ferrite plate, and the frequency variation, Δf.

TABLE 1

| lm (mm) | 1 × 1 (mm) | 1 × 2 (mm) | Δf (±MHz) |
|---|---|---|---|
| 3.25 | 3.00 | 3.81 | 6.381 |
| 5.75 | 5.04 | 8.24 | 6.703 |
| 4.60 | 4.99 | 5.66 | 6.143 |
| 2.80 | 1.82 | 3.44 | 7.104 |
| 2.13 | 0 | 2.83 | 9.397 |

EMBODIMENT 2

This embodiment has the same structure as the previous embodiment, except the permanent magnet 12 is in this case made of $CeCo_5$ (with Br=6250 G, Hc=6250 Oe, $\alpha=-0.0009$, and which has linear temperature characteristics).

Figure 5:
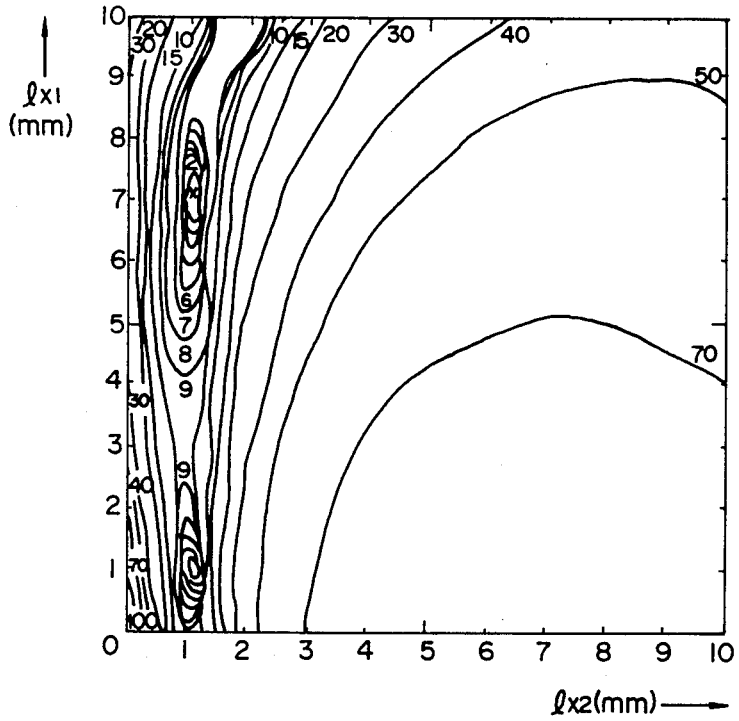

FIG. 5 shows the contour lines of Δf on the plane of the thicknesses $l_{x1}$ and $l_{x2}$ of the first and second soft magnetic plates 13 and 14. For example, the resonant frequency variation is Δf=±0.2160 MHz for $l_m$=2.44 mm, $l_{x1}$=0.89 mm and $l_{x2}$=0.98 mm; and Δf=±0.786 MHz for $l_m$=5.11 mm, $l_{x1}$=7.10 mm and $l_{x2}$=0.95 mm. This embodiment also results in the reduction of Δf by using a combination of ferrite and YIG plates, and is more effective due to the use of magnets 12 with $\alpha=-0.0009$ as compared of the case with $\alpha=-0.0005$ of Embodiment 1.

EMBODIMENT 3

Figure 6:
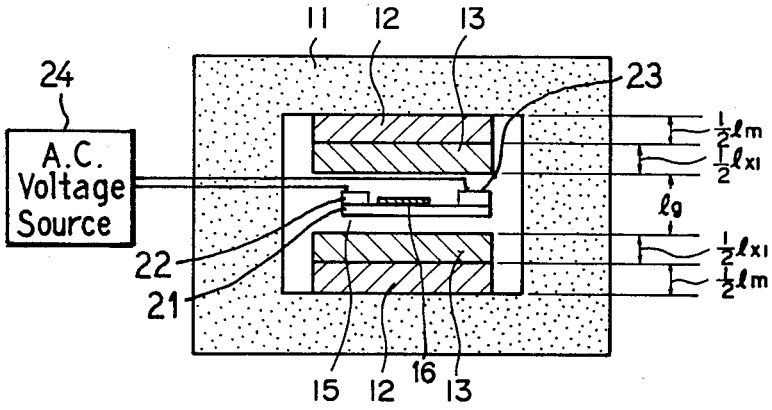

This embodiment employs permanent magnets 12 of $\alpha=-0.001$ (with Br=6300 G, Hc=5500 Oe, which have linear temperature characteristics), and uses merely the first soft magnetic plates 13 of YIG as shown in FIG. 6. FIG. 6 shows a yoke 11 with magnets 12 mounted on opposite legs and with soft magnetic plates 13 of YIG attached to the magnets 12. A magnetic device 16 is mounted in the gap 15 between plates 13. As a result, Δf=±2.224 MHz was achieved for $l_m$=3.281 mm, $l_{x1}$=3.857 mm. FIG. 6 also shows a strip line having an insulating substrate 21 upon which are formed strip lines 22 and 23 which are mounted on opposite sides of device 16. An A.C. voltage source 24 is connected across lines 22 and 23 to produce an A.C. field which passes through device 16.

According as the temperature coefficient α of the permanent magnet 12 approaches the average −0.00128 obtained from Equation (1), it becomes feasible to reduce Δf, i.e., the temperature dependency of the resonant frequency, through the use only of the YIG plate. It is also possible to reduce Δf by using two different kinds of soft magnetic plates which are made of the same material.

As mentioned above, the resonant frequency can be less temperature dependent when the soft magnetic plate is constructed of the same material as the magnetic device 16, such as a YIG material, and this will be explained in the following.

As an idealized condition, the temperature dependency of the resonant frequency disappears when the right sides of Equations (1) and (9) are equal, namely $$\frac{fo}{\gamma} + N_{zy} \cdot 4\pi M_{sy}(T) = \tag{10}$$

-continued $$\frac{l_m}{l_g + l_x} H_m(T) + \frac{l_x}{l_g + l_x} N_{zx} \cdot 4\pi M_{sx}(T)$$

Assuming that the permanent magnet has an extremely small temperature coefficient and that the Hm(T) has a constant value $H_{mo}$, Equation (10) is reduced to:

$$\frac{fo}{\gamma} + N_{zy} \cdot 4\pi M_{sy}(T) = \frac{l_m}{l_g + l_x} H_{mo} + \frac{l_x}{l_g + l_x} N_{zx} \cdot 4\pi M_{sx}(T) \tag{11}$$

In order for both sides of Equation (11) to be always equal, they need to have equal constant terms and equal temperature-dependent terms as follows.

$$\frac{fo}{\gamma} = \frac{l_m}{l_g + l_x} H_{mo} \tag{12}$$

$$N_{zy} \cdot 4\pi M_{sy}(T) = \frac{lx}{l_g + l_x} N_{zx} \cdot 4\pi M_{sx}(T) \tag{13}$$

Equation (12) gives $$H_{mo} = \frac{l_g + l_x}{l_m} \cdot \frac{fo}{\gamma} \tag{14}$$

Assuming that the YIG device and that the soft magnetic plate are both thin enough and that the $N_{zy}$ and $N_{zx}$ are substantially equal to 1, Equation (13) is reduced to:

$$4\pi M_{sy}(T) = \frac{l_x}{l_g + l_x} 4\pi M_{sx}(T) \tag{15}$$

On the further assumption that $l_g << l_x$, the constant part $l_x/(l_g+l_x)$ is approximately equal to 1, and Equation (15) is reduced to:

$$4\pi M_{sy}(T) = 4\pi M_{sx}(T) \tag{16}$$

Accordingly, with the assumption that the permanent magnet 13 has constant characteristics which are independent of temperature and that the magnetic gap 15 has a sufficiently small gap length $l_g$, the soft magnetic plate which equalizes the right sides of Equations (1) and (8) will be a YIG material which is, the material of the magnetic device.

The following indicates that the apparatus will have an extremely improved temperature characteristics when using a YIG material which is the material of the magnetic device, for forming the soft magnetic plate when the permanent magnet has a certain temperature coefficient β.

Solving the above Equation (10), which is derived by equating the above Equations (1) and (9), for $H_m(T)$ on the assumption that $N_{zx}=N_{zy}$¢1 gives:

$$H_m(T) = \frac{l_g + l_x}{l_m} \cdot \frac{fo}{\gamma} + \frac{l_g}{m} \cdot 4\pi M_{sy}(T) \tag{17}$$

Figure 7:
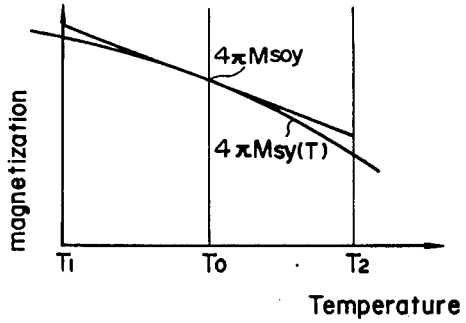
FIGS. 7 and 8 are graphs used to explain the characteristics of the apparatus according to the present invention.

Linear approximation of the temperature characteristics of YIG saturation magnetization using an average temperature coefficient α in a temperature range between $T_1$ and $T_2$ as shown in FIG. 7 gives $$4\pi M_{sy}(T) = 4\pi M_{soy}\{1+\alpha(T-T_o)\} \tag{18}$$

Substituting Equation (18) into (17) gives $$H_m(T) = \frac{l_g + l_x}{l_m} \cdot \frac{fo}{\gamma} + \frac{l_g}{l_m} \cdot 4\pi M_{soy} + \frac{l_g}{l_m} \cdot 4\pi M_{soy}\alpha(T - T_o) \quad (19)$$

This equation is expressed as follows.

$$H_m(T) = H_{mo}\{1 + \beta(T - T_o)\} \quad (20)$$

where $$H_{mo} = \frac{\{(l_g + l_x) f_o/\gamma\} + l_g \cdot 4\, M_{soy}}{l_m} \quad (21)$$

$$\beta = \frac{l_g \cdot 4\pi M_{soy}}{\{(l_g + l_x) fo/\gamma\} + l_g \cdot 4\pi M_{soy}} \cdot \alpha \quad (22)$$

$$= \frac{4\pi M_{soy}}{\{(1 + l_x/l_g) fo/\gamma\} + 4\pi M_{soy}} \cdot \alpha$$

For a given permanent magnet having linear temperature characteristics and a temperature coefficient of $\beta$, dimensions are chosen to be $$l_x/l_g = \frac{(\alpha - \beta)4\pi M_{soy}}{\beta \cdot fo/\gamma} - 1 \quad (23)$$

so that Equation (22) is satisfied, and at the same time the dimensions are adjusted depending on the field strength $H_{mo}$ of the permanent magnet to meet the following.

$$l_m \cdot H_{mo} = \{(l_g + l_x) fo/\gamma\} + l_g \cdot 4\pi M_{soy} \quad (24)$$

Then, the gap magnetic field $H_g(T)$ becomes:

$$H_g(T) = \frac{l_m}{l_g + l_x} H_m(T) + \frac{l_x}{l_g + l_x} 4\pi M_{sy}(T) \quad (25)$$

$$= \frac{l_m}{l_g + l_x} H_{mo}\{1 + \beta(T - T_o)\} + \frac{l_x}{l_g + l_x} 4\pi M_{sy}(T)$$

$$= \frac{l_m}{l_g\, l_x} \quad \frac{l_g + l_x}{l_m} \cdot \frac{fo}{\gamma} + \frac{l_g}{l_m} 4\pi M_{soy} +$$

$$\frac{l_g}{l_m} \cdot 4\pi M_{soy} \cdot \alpha(T - T_o) + \frac{l_x}{l_g + l_x} \cdot 4\pi M_{sy}(T)$$

$$= \frac{fo}{\gamma} + \frac{l_g}{l_g + l_g} \cdot 4\pi M_{soy}\{1 + \alpha(T - T_o\} +$$

$$\frac{l_x}{l_g + l_x} \cdot 4\pi M_{sy}(T)$$

The resonant frequency, f, is given, when $N_{zy}=1$, as:

$$f = \gamma\{H_g(T) - 4\pi M_{sy}(T) \equiv \quad (26)$$

The variation of the resonant frequency, $\Delta f = f - fo$, is obtained from Equations (25) and (26) as follows.

$$\Delta f = \frac{\gamma l_g}{l_g + l_x} [4\pi M_{soy}\{1 + \alpha(T - T_o)\} - 4\pi M_{sy}(T)] \quad (27)$$

Figure 8:
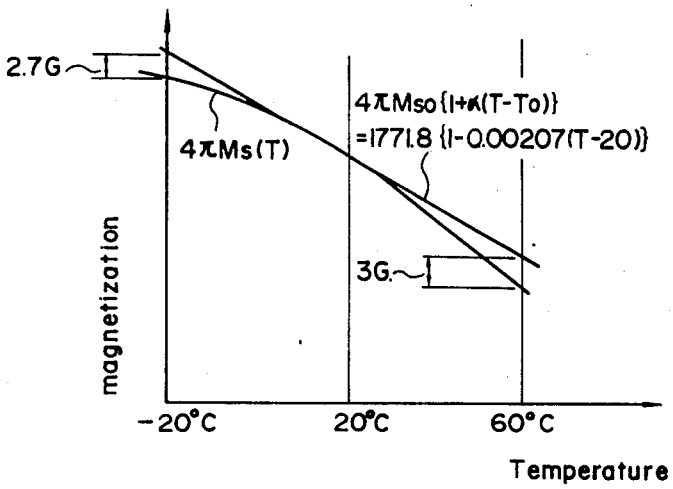

$\Delta f$ is the deviation of a $4\pi M_{sy}(T)$ from the linear approximation compressed by $l_g/(l_g+l_x)$ and further multiplied by $\gamma$, and it can be made extremely small. For example, as shown in FIG. 8, the magnetization obtained from linear approximation is 1918.5 G at −20° C. as against the measured value 1915.8, which results in a small difference of 2.7 G, and at +60° C. the measured value is 1622.1 G, while linear approximation gives 1625.1 G which is a small deviation of 3.0 G.

By setting $l_g/(l_g+l_x)=0.2$ and $\gamma=2.8$, the resonant frequency variation becomes $\Delta f = 2.8 \times 0.2 \times 3.0 = 1.68$ MHz, or as small as $\Delta f = \pm 0.84$ MHz.

It should be appreciated that the use of a soft magnetic plate made of YIG provides a magnetic apparatus with extraordinary uniform temperature characteristics, in which the resonant frequency and its temperature dependency is well compensated.

In practice, when the present invention is applied to a microwave filter, for example, a filter element is made up of a micro-strip line and a ferrimagnetic resonator device of a certain formation and is placed on a dielectric substrate which is placed in the filter gap 15. This arrangement is shown by FIG. 6.

Although in the foregoing embodiments the soft magnetic plate is formed of one or two kinds of materials, it can be formed of three or more kinds of materials.

Although the foregoing embodiments have been described for the cases with YIG ferromagnetic resonators as the magnetic devices, the present invention can also be applied to any magnetic apparatus employing a resonator of other material. Also the invention can be used with other type of magnetic devices, such as magnetoresistance effect devices which are operated in a d.c. magnetic field produced by a magnetic circuit.

According to the present invention, as described above, a magnetic circuit for producing a d.c. biasing magnetic field is constructed to include a soft magnetic plate of the same material as the magnetic device whereby the d.c. magnetic field is accurately and easily compensated for temperature variations vary precisely so as to control the curvature of the temperature characteristics. Moreover, by using combined materials, for example, one for a coarse adjustment so as to model the slope of the temperature characteristics and, the other for a fine adjustment so as to model the curvature of the temperature characteristics, the temperature compensation can be accomplished accurately and easily. Accordingly, the present invention can advantageously be applied to various magnetic apparatuses such as microwave filters.

We claim:

1. A magnetic apparatus comprising:

a magnetic circuit including a rectangular shaped magnetic yoke having first, second, third and fourth legs being configured to enclose a central rectangular shaped opening, said first and third legs facing each other, and a magnet mounted in said central rectangular opening and attached to said first leg, and a magnetic gap formed in said magnetic circuit between said first and third legs and in which a uniform d.c. biasing magnetic field is formed;

a thin film YIG magnetic device, made of magnetic material of a selected composition, mounted in said magnetic gap between said first and third legs so that said device operates in said d.c. biasing magnetic field; and a soft magnetic plate mounted in said d.c. biasing magnetic field between said magnet and third leg, said soft magnetic plate made of magnetic material which has substantially the same composition as said YIG magnetic device.

2. A magnetic resonator comprising:

a magnetic circuit including a rectangular shaped magnetic yoke having first, second, third and fourth legs being configured to enclose a central rectangular shaped opening and a pair of magnets mounted in said central rectangular opening and respectively, attached to said first and third legs, and a magnetic gap formed in said magnetic circuit between said first and third legs and in which a uniform d.c. biasing magnetic field is formed;

a thin film YIG ferrimagnetic resonator device, formed of a thin film of ferrimagnetic yttrium iron garnet of a selected composition, mounted in said magnetic gap between said pair of magnets so that said device operates in said d.c. biasing magnetic field; and a pair of soft magnetic plates mounted in said d.c. biasing magnetic field and respectively connected to said pair of magnets adjacent said YIG ferrimagnetic resonator device, said pair of soft magnetic plates made of ferrimagnetic yttrium iron garnet which has substantially the same composition as said resonator device.

3. A ferromagnetic resonator comprising:

a magnetic circuit including a rectangular shaped magnetic yoke having first, second, third and fourth legs being configured to enclose a central rectangular shaped opening and a magnet mounted in said central opening and attached to said third leg, and a magnetic gap formed in said magnetic circuit between said magnet and said first leg in which a uniform d.c. biasing magnetic field is formed;

a thin film ferrimagnetic resonator device, formed of a thin film of ferrimagnetic yttrium iron garnet of a selected temperature dependency of magnetization mounted in said magnetic gap between said magnet and first leg so that said device operates in said d.c. biasing magnetic field; and a soft magnetic plate mounted in said d.c. biasing magnetic field between said magnet and first leg and adjacent said YIG ferrimagnetic resonator device, said soft magnetic plate made of ferrimagnetic yttrium iron garnet which has a temperature versus magnetization characteristic which is substantially identical to that of said resonator device.

4. A ferromagnetic resonator according to claim 2 or 3, which includes means for applying an RF magnetic field, to said ferrimagnetic resonator device.

5. A ferromagnetic resonator according to claim 2 or 3, wherein said thin film of yttrium iron garnet is formed on non-magnetic garnet material with a process of liquid phase epitaxial growth.

6. A ferromagnetic resonator according to claim 4, wherein said means for applying an RF magnetic field comprises a micro-strip line.

* * * * *